US006688954B2

(12) United States Patent
Spears

(10) Patent No.: US 6,688,954 B2
(45) Date of Patent: Feb. 10, 2004

(54) WET/DRY BLOCK

(76) Inventor: Richard Spears, 122 County Rd. 306, Iuka, MS (US) 38852

( * ) Notice: Subject to any disclaimer, the term of this patent is extended or adjusted under 35 U.S.C. 154(b) by 90 days.

(21) Appl. No.: 09/943,681

(22) Filed: Aug. 31, 2001

(65) Prior Publication Data

US 2003/0060150 A1 Mar. 27, 2003

(51) Int. Cl.[7] ..... B24B 23/00

(52) U.S. Cl. ..... 451/355; 455/344; 455/524; 51/391; 51/358

(58) Field of Search ..... 451/355, 344, 451/461, 502, 503, 514, 523, 524; 51/262, 266, 267, 358, 382, 388, 391; 401/27, 137, 139, 203, 204

(56) References Cited

U.S. PATENT DOCUMENTS

| | | | | | |
|---|---|---|---|---|---|
| 1,599,906 | A | * | 9/1926 | Knight | 451/503 |
| 2,112,593 | A | | 3/1938 | Campbell | |
| 2,765,593 | A | | 10/1956 | Salmon et al. | |
| 2,922,177 | A | | 1/1960 | Hudson | |
| 4,221,084 | A | | 9/1980 | Frantzen | |
| 4,320,601 | A | | 3/1982 | Haney | |
| 4,484,419 | A | | 11/1984 | Freerks | |
| 4,922,665 | A | | 5/1990 | Wanatowicz | |
| 5,054,248 | A | * | 10/1991 | Thayer | 451/524 |
| 5,512,010 | A | | 4/1996 | Labad, Jr. | |
| D371,948 | S | * | 7/1996 | Liu | D8/90 |
| 5,863,243 | A | | 1/1999 | Ali | |
| D406,037 | S | | 2/1999 | Ali | |
| 6,062,966 | A | * | 5/2000 | Ali et al. | 451/503 |
| 6,431,970 | B2 | * | 8/2002 | Eberhard | 451/490 |

* cited by examiner

*Primary Examiner*—Joseph J. Hail, III
*Assistant Examiner*—Anthony Ojini

(57) ABSTRACT

The present invention relates to an inexpensive, lightweight, effective, manually operated wet/dry sanding block having the capability to operate in the dry mode or the wet mode equally well. A hole through the center of the block allows fluid to be delivered to the bottom surface of the block during operation. Grooves on the bottom surface of the block allow the water to be evenly distributed to both sides of the block during operation. The design of the block is such that no nails, spikes, grooves or fasteners of any kind are needed to hold the abrasive paper in place. One edge of the block is designed to have a small radius of curvature allowing access to narrow spaces, such as door jambs.

19 Claims, 5 Drawing Sheets

WET/DRY BLOCK

BACKGROUND

1. Field of Invention

This invention relates to the field of manually operated hand sanders, in particular, the sanding/finishing of car, boat, and truck bodies.

2. Description of Prior Art

A prior art patent search was conducted and a list of patents which appeared to be most pertinent to the invention follows:

U.S. Pat. No. 4,320,601 Haney, Mar. 23, 1982, shows a manual operable sanding block through which a means for delivering water to the work surface is provided. Specifically, the wet sander comprises a block of a size and shape to be comfortably held in a person's hand. It is rectangular in shape, including two end walls, two sidewalls, the gripping portion including an upper surface, and the base as the lower surface. Pins are embedded in the gripping portion beneath each of the two flaps, that penetrate and retain the ends of the sandpaper which extends across the bottom of the base. A fluid conduit (tube) extends through the side wall of the base and exits through the end wall of the base, forming an L-shaped path through the base, delivering fluid to the work surface in front of the sanding block. An additional feature is a valve positioned in the L-shaped tube allowing the flow of fluid (or water) to be controlled. The disadvantages of this invention are that the movement of the sander is limited to forward and backwards movement because the water is sprayed out of the front of the sander. Also, since there is a valve on the top of the sander to control the water pressure, the valve itself causes an obstruction for the user, and the pressure coming into the sander will be high, leaving the hose rigid and hard to maneuver. The hose or tubing coming into the side of the sander will be awkward and the spikes used to hold the abrasive paper in place can be dangerous and make it difficult to safely remove and insert the paper.

U.S. Pat. No. 5,512,010 Labad, Jr. Apr. 30, 1996, shows a manual wet sanding block having means for supplying liquid from an external source through the sanding block onto the work surface. Specifically, the sanding block comprises a hollow, rigid base, generally shaped in parallelpiped form designed for the ergonomic comfort of the hand of the user, comprising a top, a flat bottom, a right side, a left side, a hollow interior and two spring clamps. A flexible hose connected to the rigid base allows water to flow into the hollow interior of the base and out through holes to a resilient surface located under the flat bottom of the base. The resilient bottom has eight perforations that allow liquid to flow through to the sandpaper or abrasive surface. The sandpaper is supported by the resilient surface and is held in place by two spring clamps, one on each extremity of the rigid base. An additional feature of this wet sanding block is a rubber flexible wiper located on a left side of the rigid base serving to wipe the surface during the sanding process. This sanding block is large and heavy because the interior reservoir must be filled with water for optimum performance. The tube leading to the sander has a restricted flow orifice which controls the water flow to the reservoir. Consequently, it takes a long time to fill. It seems that when using this sander in the vertical position, it would be difficult for the water to be evenly distributed if the water pressure was anything but high. If the water pressure is high, then the hose leading to the conduit would be rigid and more difficult to maneuver. Otherwise the reservoir wouldn't remain filled and water could not get to the upper holes. The wiper blade adds weight and throws the balance of the sander off. The wiper blade also makes that side of the sander useless for sanding corners etc. There are many moving parts on this sander, some of which are metal which make them more likely to fail or wear (rust, etc).

U.S. Pat. No. 4,922,665 shows a manually operated wet sander comprising a body through which water is supplied to the sanding surface. The wet sander has a contoured handle. The body is constructed from a solid piece of rubber, or other suitable material. A thin cushion of durable material is attached to the bottom of the body. Sand paper is wrapped around the thin cushion and held in place by grooves which are located on opposite sides of the sander. An inlet for introduction of a liquid from an external source is provided at the top surface of the sander. An adapter is used to connect a hose between an external liquid source and the inlet. Liquid flows from the inlet through a conduit and out through a plurality of outlets in the bottom body of the sander and out along the edges of the sandpaper onto the work surface. An additional embodiment is shown where the front of the sander has jaws (grooves) to hold the front end of the sandpaper in place and a roll of sandpaper is attached to the back of the sander, providing a continuous supply of fresh sandpaper. This sander is heavier and bulkier to use and has moving parts (springs and levers, etc.) which are more likely to fail.

U.S. Pat. No. 2,765,593 Salmon et al. teaches a manual sanding block for dry sanding only, that is essentially rectangular with a rounded gripping portion. The ends of the block are horizontally bisected by slits which extend to the interior of the block. The surfaces of the slits have complementary recesses, ridges, to hold the ends of the abrasive paper in place. One end of the sanding block is square, while the other end is rounded. The abrasive paper folds over the lower rounded edge and is held in the slit. While this rounded end will be useful for large concave surfaces, it will not be usable in areas with small radiuses of curvature, such as door jambs. Also, because of the design of the block and the size of the curved edge, the user's hand will come in contact with the abrasive paper during use, causing potential discomfort.

SUMMARY OF THE INVENTION

An objective of the invention is to provide a manually operated universal sanding block that is lightweight, inexpensive, and can be used in the wet mode or dry mode equally well.

A further objective of this invention is to provide a manually operated sanding block which during wet operation provides a sufficient and evenly distributed flow of fluid, such as water, to the work surface when attached to a higher pressure external valved source of fluid, such as a garden hose, without the need for incorporating an independent mechanical valve or regulator.

A further objective of this invention is to provide a manually operated sanding block in which the abrasive material can be easily and safely loaded and unloaded without harm to the user, the sanding block, or the paper.

A further objective of this invention is to provide a manually operated sanding block that can be used horizontally, vertically, and for narrow, hard to reach spaces, such as door jambs or areas with a small radius of curvature.

A further objective of this invention is to provide a manually operated sanding block that has no metal/moving parts that will wear of fail with time and use.

Other objectives of the invention will become readily apparent to those skilled in the art from the following description and the accompanying drawings.

BRIEF DESCRIPTION FO THE DRAWINGS

FIG. 1 a perspective view of the wet/dry sanding block with the flexible hose attached as would view it in the wet block sanding mode.

DETAILED DESCRIPTION

The present invention provides an inexpensive, lightweight, effective, manually operated wet/dry hand sander.

Figure 1:
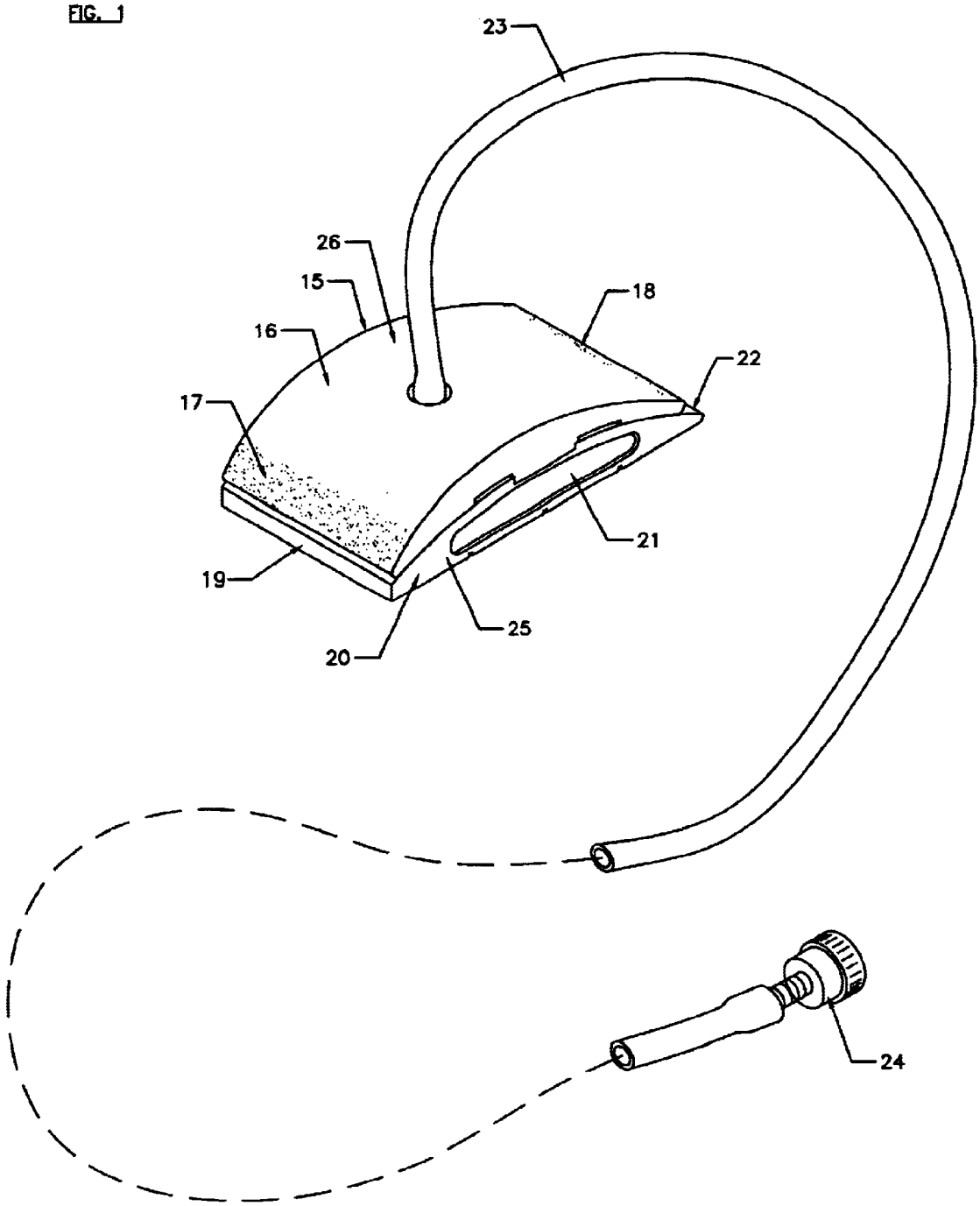

Referring more specifically to the drawings, the wet/dry hand sander, 15, shown in FIG. 1, has a generally rectangular shape comprising a base portion 25 and a gripping portion 26. The body of the wet/dry sander is preferably constructed from a solid, rigid material, such as rubber, or other suitable material. While the body is made from a rigid material, it is the design of the body that allows for the desired flexibility.

Figure 4:
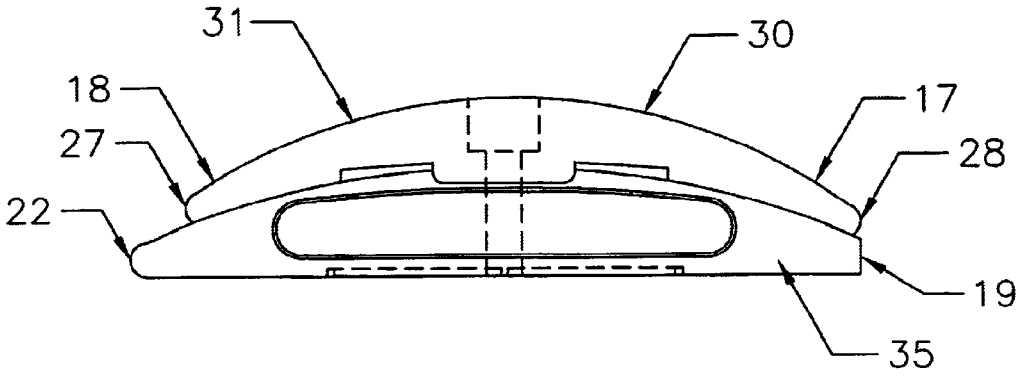
FIG. 4 is an elevation right side view thereof.
Figure 8:
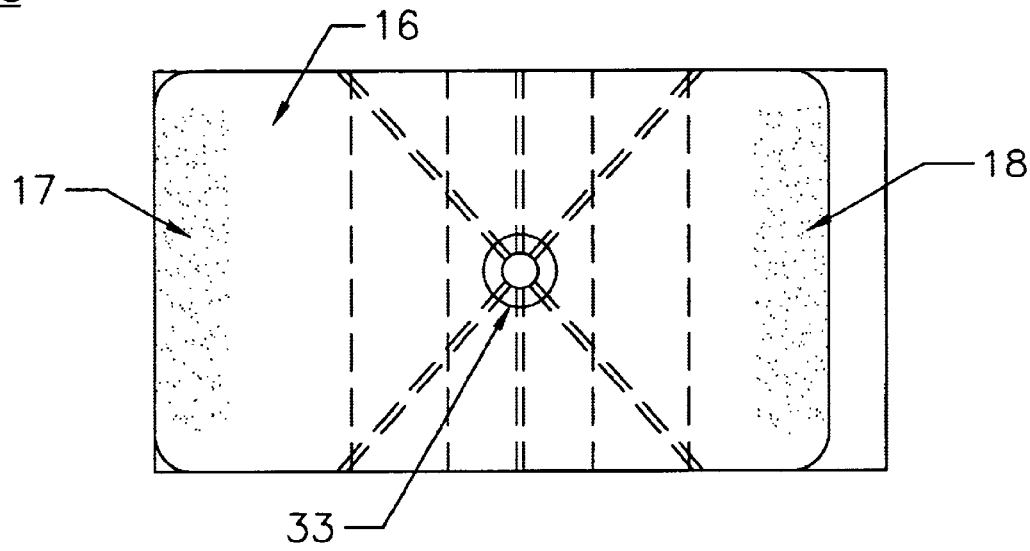
FIG. 8 is a top plan view of the block.

The wet/dry sander is sized to fit conveniently in a user's hand and the gripping portion is rounded, 16, and each end of the top surface is slightly raised and textured, forming indentations for the finger, 17, and the palm, 18, so that it is shaped to fit comfortably when the user applies downward pressure on the sander during operation, see FIGS. 1, 4, and 8.

The gripping portion is suitably secured to the base portion by an appropriate adhesive or process (not shown here) in the center of the wet/dry block. The thickness of the gripping portion is slightly increased, 29, in the area that will be attached to the base portion to increase stability and alignment during the manufacturing process, see FIG. 2. While this is the preferred embodiment, it is not a requirement for the invention to perform as desired. The bottom center of the gripping portion, 32, is attached to the upper surface of the base portion at its center. The bottom surface of the gripping portion and the top surface of the base portion are not secured at either edge, thus creating flaps 30 and 31, see FIGS. 2 and 4.

The lower surface of the gripping portion and the upper surface of the base portion are shaped in a complementary configuration. The shape of the surfaces are shown to be curved in drawings 2–4, however, the shape is not limited. Flat, concave, convex and any other complementary shape is suitable. When the wet/dry block is not in use (no abrasive paper), the complementary surfaces are designed to be in continuous contact.

End walls 27 and 28 of the gripping portion are curved to make it easier for the user to grab and separate the flaps 30 and 31 from the base portion when inserting or removing the abrasive paper. A strip of abrasive paper is attached by lifting a flap up away from the base portion of the block, inserting one end of the abrasive paper strip between the flap and the base portion and releasing the flap to allow the flap to return to its normal position down against the base portion, thus securing the first end of the abrasive paper. The abrasive paper is then stretched across the bottom surface of the base portion of the block, 41, and held tightly in place while the other end is inserted between the opposite flap and base portion. The ends of the abrasive paper are held firmly in place during use. This design has eliminated the need for nails, grooves, spikes and any other type of fastener to hold the abrasive paper in place.

Figure 2:
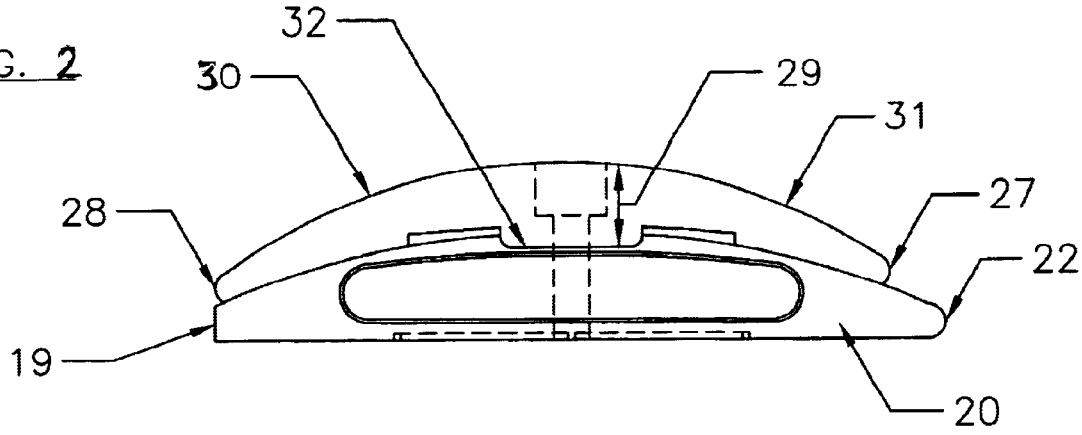
FIG. 2 is an elevated left side view thereof.
Figure 3:
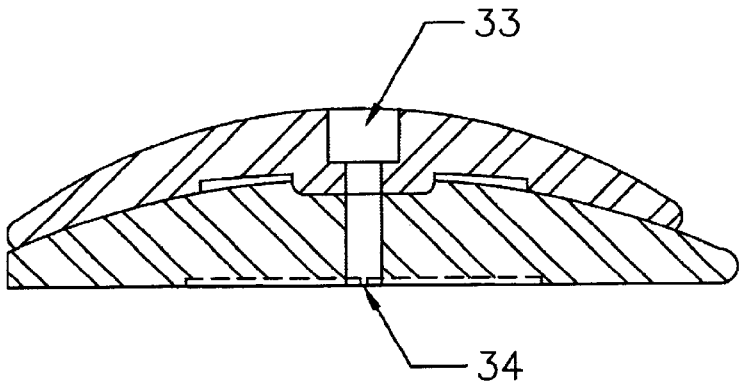
FIG. 3 is a cross section of left side thereof.

The base portion has end walls 19 and 22 and side walls 20 and 35. The end walls are shown in FIGS. 2 and 4 where one end wall, 22, at the rear of the block is curved and the other end wall of the front of the block is square, 19. The base portion at the rear of the block extends up to ⅜ inch past the end wall of flap, 31, to allow access to narrow spaces and delicate sanding, such as around door jambs. The design is such that the user's hand should never come in contact with the abrasive paper. The small radius of curvature of the end wall of the base portion enables the user to smooth areas with a radius of curvature as small as ⅛ inch. It is also quite effective on concave and convex surfaces.

Each side 35 and 20 shows concavities 21 for grasping the wet/dry sanding block. The size and shape of these concavities are not limited to those shown in the drawings.

Figure 5:
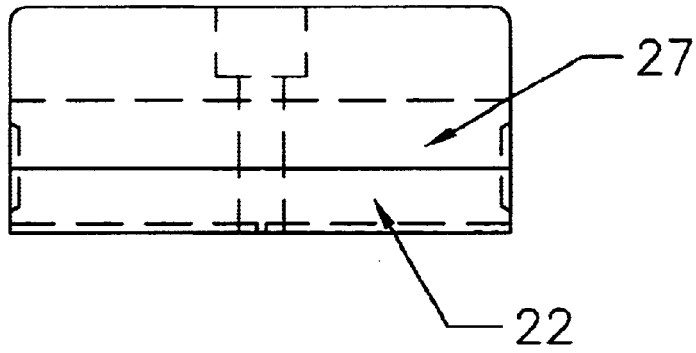
FIG. 5 is an elevation of rear end thereof.
Figure 6:
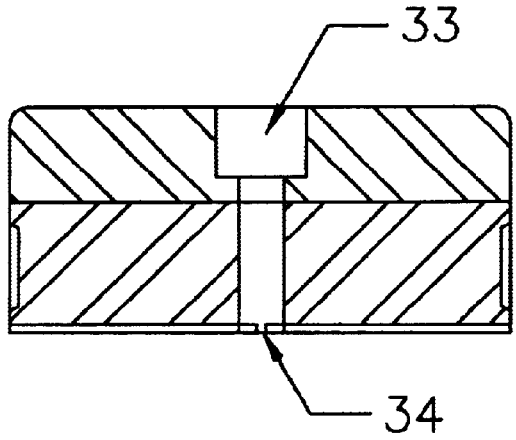
FIG. 6 is a cross section of rear end thereof.
Figure 7:
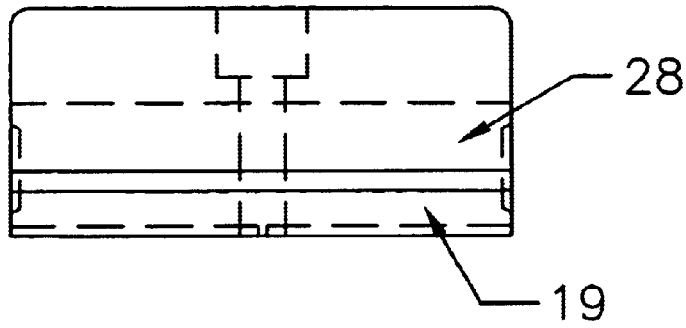
FIG. 7 is an elevation of front end thereof.
Figure 10:
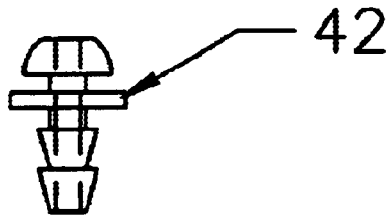
FIG. 10 is a side view of the barbed hose connector.

According to the invention, fluid, such as water, may be delivered directly to the work surface through the wet/dry sanding block. A hole 33,34 extends through the center of the wet/dry block containing a counter sunk fitting which in the preferred embodiment is a modified barbed connector, 42, (see FIG. 10) to which conduit or tubing may be easily attached, see FIGS. 5–7. The design of the modified barbed connector is such that no clamps are needed to hold the tubing in place. Fittings can be made of brass, plastic, or any other suitable material. The barbed connector fits into the larger diameter portion of the hole, 33. The hole is placed in the center of the block so that during wet operation the tubing will fit comfortably between the user's fingers. If dry operation is desired, the tubing is easily removed (by pulling) and will not hinder the user's operation. A standard hose to tube fitting is attached to the other end of the tubing so that it can be connected to a conventional hose. The flow of fluid through the sander is controlled by controlling the water pressure of the conventional hose. If the valve on the conventional hose is opened to maximum capacity, then the diameter of the tubing or conduit connected to the conventional hose determines the maximum flow rate of fluid (water) to the wet/dry block.

Figure 9:
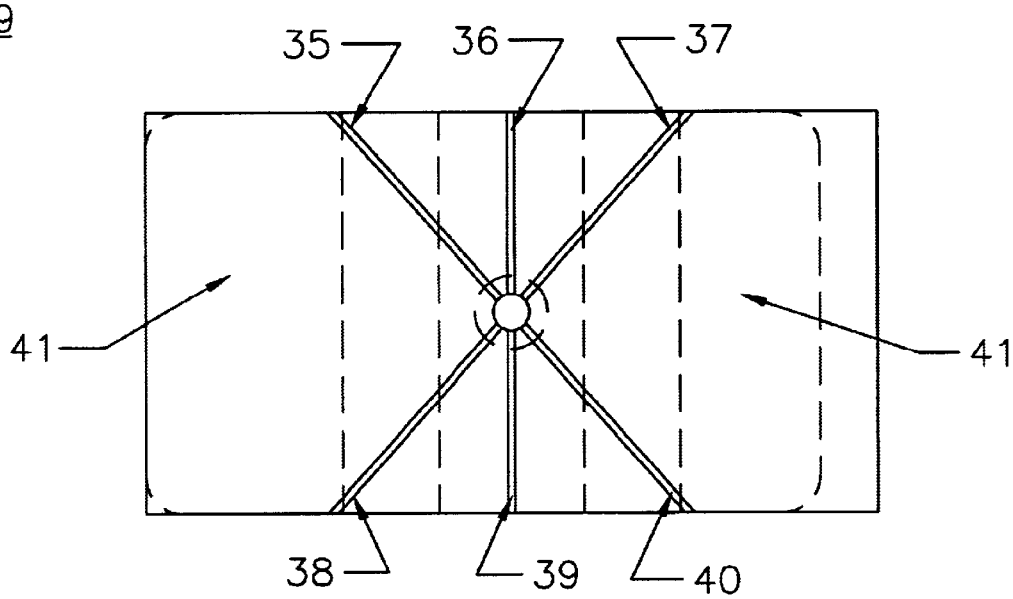
FIG. 9 is a bottom plan view of the block.

The flat bottom of the base portion, 41, has a rectangular shape with a hole in the center. Six square cut grooves extend from the center hole, 34, to evenly distribute the fluid to each side of the sander during wet operation. Two of the grooves 36 and 39 extend from the hole, directly across the width of the flat bottom base. The other four grooves 35, 37, 38, and 40, extend radially from the hole, two on each side, approximately 48 degrees or 1.25 inches from the original grooves, (36 and 39), see FIG. 9. The number and position of the grooves must be the same on each side of the sander so that the water will be evenly distributed during operation.

One skilled in the art will recognize at once that it would be possible to construct this invention from a variety of materials. While the preferred embodiment of the present invention has been described in detail and shown in the accompanying drawings, it will be evident that various modifications are possible without departing from the scope of the invention.

What is claimed is:

1. A manually operated wet/dry block having a top surface, a bottom surface, a front, a back, and two sides wherein said front and back each have a flap and a base portion is curved and for securing a strip of abrasive paper to the bottom surface of said wet/dry block, comprising:

a gripping means by which a user can hold said wet/dry block when said wet/dry block is in use, a front and/or a back that has a base portion that extends past an end wall of said flap, wherein an end wall of said base portion has a small radius of curvature that is no more than ⅛ inch enabling it to smooth areas with a radius of curvature as small as ⅛ inch, as well as concave and convex surfaces.

2. The wet/dry block of claim 1 in which said gripping means is a curved surface designed to fit a palm of a user's hand wherein one or both ends of said curved surface is slightly raised, forming indentations for a finger and/or a palm of said user's hand.

3. The wet/dry block of claim 2, in which each end of said curved surface is textured.

4. The wet/dry block of claim 1, in which an end wall of said flap is curved.

5. The wet/dry block of claim 1, wherein a bottom surface of said gripping means and a top surface of said base portion are complementary surfaces.

6. A manually operated wet/dry block having a top surface, a bottom surface, a front, a back, and two sides wherein said front and back each have a flap and a base portion for securing a strip of abrasive paper to the bottom surface of said wet/dry block, comprising:

a gripping means by which a user can hold said wet/dry block when said wet/dry block is in use;

a front and/or a back that has a base portion that extends past an end wall of said flap, wherein an end wall of said base portion is curved and has a small radius of curvature that is no more than ⅛ inch enabling it to smooth areas with a radius of curvature as small as ⅛ inch, as well as concave and convex surfaces and;

a hole through said wet/dry block containing a connector to which removable conduit or tubing is attached for delivery of fluid to said bottom surface of said base portion.

7. The wet/dry block of claim 6, in which said gripping means is a curved surface designed to fit a palm of a user's hand wherein one or both ends of said curved surface is slightly raised, forming indentations for a finger and/or a palm of said user's hand.

8. The wet/dry block of claim 7, in which each end of said curved surface is textured.

9. The wet/dry block of claim 6, wherein said bottom surface of said base portion has a plurality of grooves extending from said hole to evenly distribute said fluid to each side of said wet/dry block during operation.

10. The wet/dry block of claim 9, wherein said grooves are square cut.

11. The wet/dry block of claim 9, wherein said bottom surface of said base portion has six grooves.

12. The wet/dry block of claim 11, wherein said grooves are square cut.

13. The wet/dry block of claim 6, in which an end wall of said flap is curved.

14. The wet/dry block of claim 6, wherein a bottom surface of said gripping means and a top surface of said base portion are complementary surfaces.

15. The wet/dry block of claim 6, wherein an end wall of said hap is curved.

16. A manually operated wet/dry block having a top surface, a bottom surface, a front, a back, and two sides wherein said front and back each have a flap with a curved end wall and a base portion for securing a strip of abrasive paper to the bottom surface of said wet/dry block, comprising:

a gripping means by which a user can hold said wet/dry block when said wet/dry block is in use, wherein said gripping means is a curved surface designed to fit a palm of a user's hand wherein one or both ends of said curved surface is slightly raised, forming indentations for a finger and/or a palm of said user's hand, and wherein a bottom surface of said gripping means and a top surface of said base portion are complementary surfaces, a front and/or a back that has a base portion that extends past an end wall of said flap, wherein an end wall of said base portion is curved and has a small radius of curvature that is no more than ⅛ inch enabling it to smooth areas with a radius of curvature as small as ⅛ inch, as well as concave and convex surfaces and;

a hole through said wet/dry block containing a connector to which removable conduit or tubing is attached for delivery of fluid to said bottom surface of said base portion, wherein said bottom surface has a plurality of grooves extending from said center hole.

17. The wet/dry block of claim 16, in which each end of said curved surface is textured.

18. The wet/dry block of claim 16, in which said plurality of grooves are square cut.

19. The wet/dry block of claim 16, wherein said bottom surface of said base portion has six grooves.

* * * * *